US007040051B2

(12) United States Patent
Windorski

(10) Patent No.: US 7,040,051 B2
(45) Date of Patent: May 9, 2006

(54) TABBED NOTES AND FLAGS

(75) Inventor: David C. Windorski, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/884,045

(22) Filed: Jul. 2, 2004

(65) Prior Publication Data

US 2006/0000133 A1 Jan. 5, 2006

(51) Int. Cl.
*G09F 23/10* (2006.01)

(52) U.S. Cl. ..... 40/641; 281/42; D19/34

(58) Field of Classification Search ..... 40/360, 40/630, 641; 281/44; 283/36–43; 116/234–239; D19/34; 248/467
See application file for complete search history.

(56) References Cited

U.S. PATENT DOCUMENTS

| | | | | |
|---|---|---|---|---|
| 399,417 | A | 3/1889 | Lane | |
| 1,584,238 | A | 5/1926 | Menger | |
| 2,081,095 | A * | 5/1937 | Mull | 248/467 |
| 3,552,047 | A | 1/1971 | Dalziel | |
| 3,604,067 | A | 9/1971 | Brown | |
| 4,041,575 | A * | 8/1977 | MacArthur | 248/467 |
| 4,143,477 | A | 3/1979 | Reynolds | |
| 4,232,461 | A | 11/1980 | Crawford et al. | |
| 4,477,048 | A * | 10/1984 | Conway | 248/447.1 |
| 4,572,380 | A * | 2/1986 | Langwell | 211/57.1 |
| 4,693,441 | A * | 9/1987 | Conway | 248/220.41 |
| 4,770,320 | A | 9/1988 | Miles et al. | |
| 4,781,306 | A | 11/1988 | Smith | |
| 4,907,825 | A | 3/1990 | Miles et al. | |
| 5,287,823 | A | 2/1994 | Jiang | |
| 5,423,436 | A * | 6/1995 | Morrow | 211/59.1 |
| 5,495,644 | A | 3/1996 | Mesher et al. | |
| 5,683,194 | A | 11/1997 | Emmel et al. | |
| 5,707,032 | A | 1/1998 | Ehrlich | |
| 5,769,270 | A | 6/1998 | Fujisawa et al. | |
| 5,806,222 | A | 9/1998 | Shaffer | |
| 5,870,802 | A | 2/1999 | Goldman | |
| 5,876,817 | A | 3/1999 | Mathna et al. | |
| 5,967,561 | A | 10/1999 | Glenn | |
| 6,090,461 | A | 7/2000 | Frank et al. | |

FOREIGN PATENT DOCUMENTS

| | | |
|---|---|---|
| DE | 3341248 | 5/1985 |
| DE | 38 36 615 | 5/1990 |
| DE | 296 01 982 | 6/1997 |
| DE | 19704211 | 8/1998 |
| FR | 2 460 793 | 1/1981 |
| FR | 2666386 | 6/1992 |
| GB | 103237 | 1/1917 |

(Continued)

OTHER PUBLICATIONS

U.S. Appl. No. 10/884,046; Windorski, David C.; Fold-Over Notes; filed on Jul. 2, 2004.

(Continued)

*Primary Examiner*—Cassandra Davis

(57) ABSTRACT

A tab for attaching to sheet material comprises a substrate, a cut and an adhesive. The substrate includes a front side and a back side opposite the front side, and the substrate further includes an upper portion and a lower portion. The cut through the upper portion of the substrate forms a flap. The adhesive is along the lower portion of the back side of the substrate, and the upper portion of the substrate is free of adhesive.

2 Claims, 3 Drawing Sheets

FOREIGN PATENT DOCUMENTS

| | | |
|---|---|---|
| GB | 2298890 | 9/1996 |
| JP | 05 050782 | 3/1993 |
| JP | 1999-82467 | 3/1999 |
| JP | 2001-191672 | 7/2001 |
| JP | 2002-130243 | 5/2002 |
| JP | 2002-264573 | 9/2002 |
| SE | 7902776 | 9/1980 |
| WO | WO 89/06602 | 7/1989 |
| WO | WO 91/05321 | 4/1991 |
| WO | WO 93/20547 A | 10/1993 |

OTHER PUBLICATIONS

U.S. Appl. No. 10/859,395; Kitchin, et al.; Adhesive Clip Assembly; filed on Jun. 2, 2004.

* cited by examiner

TABBED NOTES AND FLAGS

BACKGROUND OF INVENTION

The present invention relates to an adhesive coated planar article. More specifically, the present invention relates to an adhesive coated planar article having a cut-out flap for receiving a portion of a sheet of paper to form a tab.

In working with large stacks of documents, it is often desirable to categorize the documents or to flag a document that is of particular importance. Tabs are useful to categorize documents by signaling when one category ends and another begins or to highlight a page of particular importance. In addition to flagging a page, it is often desirable to also make notes on that page. However, depending on the importance of maintaining the original document, marking directly on the flagged page may not be desirable.

To flag a page of paper from a stack or binder of papers, typically a separate tab page is inserted into the binder or an adhesive backed paper is attached to the flagged paper. Adding a separate tab page adds to the bulk of the stack of papers. Further, a separate tab page does not allow notes to be placed in direct connection to a document because the tab page precedes the related documents.

Using an adhesive backed paper to flag a page can be useful in flagging the page and providing a writing surface. However, the use of an adhesive note such as a 3M Post-it® brand note for this purpose may not properly align the note with the flagged paper, resulting in nonuniform tabs extending from the page (e.g., tab of different lengths, tilted tabs, etc.). Marked documents with nonuniform tabs may make the collection of papers appear unorganized and unprofessional.

BRIEF SUMMARY

A tab for attaching to sheet material comprises a substrate, a cut and an adhesive. The substrate includes a front side and a back side opposite the front side, and the substrate further includes an upper portion and a lower portion. The cut through the upper portion of the substrate forms a flap. The adhesive is along the lower portion of the back side of the substrate, and the upper portion of the substrate is free of adhesive.

While the above-identified figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the spirit and scope of the principals of this invention. The figures may not be drawn to scale. Like reference numbers have been used throughout the figures to denote like parts.

DETAILED DESCRIPTION

Figure 1:
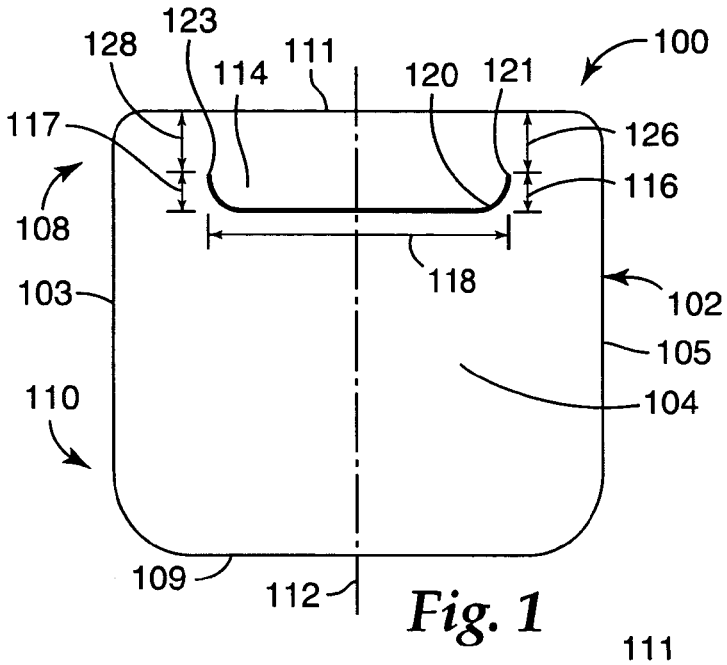
FIG. 1 is a plan view of a front side of a tab.
Figure 2:
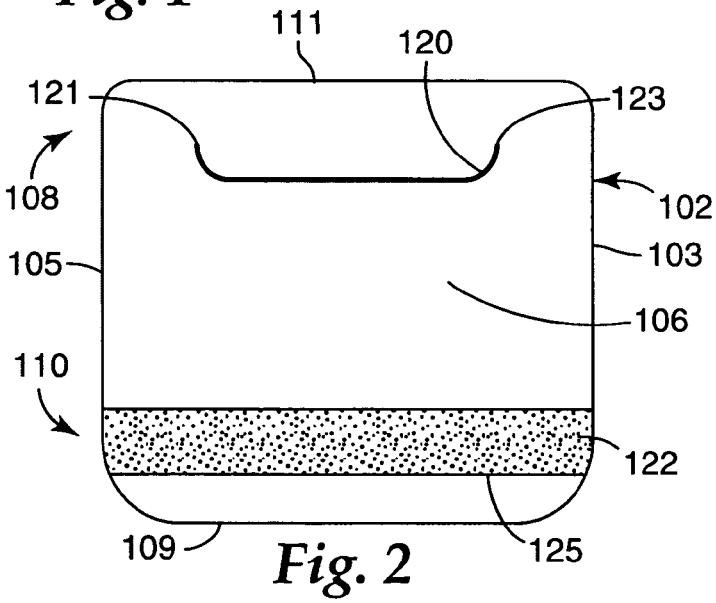
FIG. 2 is a plan view of a back side of the tab.

FIG. 1 is a plan view of a front side 104 of a tab 100. The tab 100 comprises a substrate 102 having an internal cut 120 therethrough. The substrate 102 can be paper, card stock paper, thin-film plastic or any similar type of flexible material. The substrate 102 has a first side edge 103, a second side edge 105, a lower edge 109, and upper edge 111. The substrate 102 has an upper portion 108 and a lower portion 110. Along the upper portion 108 is the upper edge 111 of the substrate, and along the lower portion 110 is the lower edge 109. The substrate 102 has a front side 104 and a back side 106, as shown in FIG. 2.

The substrate 102 in the embodiment shown in FIG. 1 is generally rectangular shaped with rounded edges and is generally symmetrical about a longitudinal axis 112. However, in other embodiments, the substrate 102 can be asymmetrical about a longitudinal axis 112. The radius of each of the rounded edges at the upper portion 108 is smaller than the radius of each of the rounded edges at the lower portion 110 to provide a visual and tactile signal to the user relative to the top and bottom of the tab 100.

The cut 120 extends through the upper portion 108 of the substrate 102. The cut 120 has a first end 121 and a second end 123. Overall, the cut 120 has a width 118, a first length 116, and a second length 117. A first distance 126 from the first end 121 of the cut 120 to the upper edge 111 of the tab 100 is equal to a second distance 128 from the second end 123 of the cut 120 to the upper edge 111 of the tab 100. The cut 120 is shown as being symmetrical or a mirror-image about the longitudinal axis 112 so that the width 118 and the length 116 and 117 of the cut 120 on each side of the longitudinal axis 112 are the same. The cut 120 is shown as U-shaped, but may be any other suitable shape to define a flap 114.

The cut 120 through the substrate 102 forms a flap 114. The substrate 102 is generally constructed of a flexible material, and thus the flap 114 is likewise flexible.

FIG. 2 is a plan view of the back side 106 of the tab 100. On the back side 106 of the substrate 102 is a band of adhesive 122. The adhesive 122 is positioned at the lower portion 110 of the back side 106 of the substrate 102 opposite from the cut 120. The band of adhesive 122 extends from the first side edge 103 to the second side edge 105. A lower edge 125 of the band of adhesive 122 is spaced from lower edge 109 of substrate 102 to facilitate handling of the tab 100.

The adhesive 122 may be a permanent adhesive or any suitable pressure sensitive adhesive or repositionable pressure sensitive adhesive such as the repositionable pressure sensitive adhesives used on Post-it® notes, manufactured by 3M Company, St. Paul, Minn. Exemplary repositionable pressure sensitive adhesives comprising solid microspheres are described in U.S. Pat. No. 5,571,617 (Cooprider, et al.) and U.S. Pat. No. 5,824,748 (Kesti, et al.). Other pressure sensitive adhesives can also be used. Preferably, the adhesives used in the present invention are repositionable, thereby making tab 100, itself, "repositionable."

Figure 3:
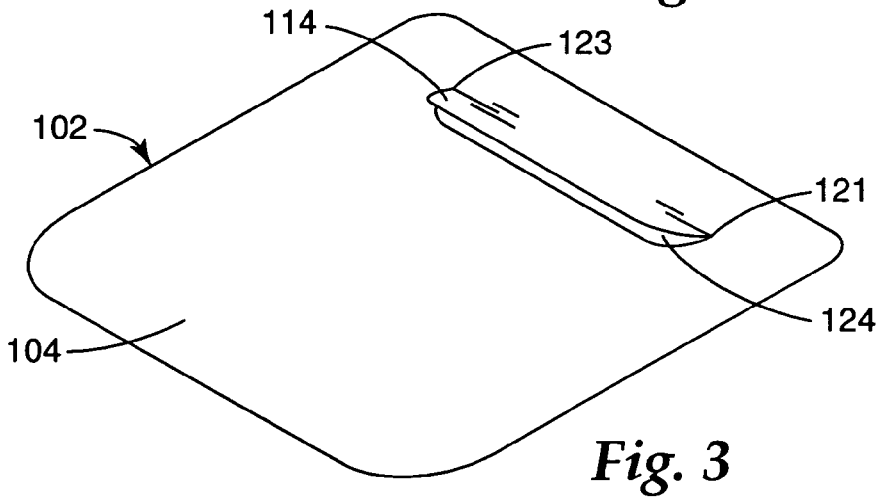
FIG. 3 is a perspective view of the tab of FIG. 1, from the front side thereof.

FIG. 3 is a perspective view of the tab 100 of FIG. 1. As shown, the flap 114 is flexible and may be moved out of the plane of either the front side 104 or the back side 106 of the substrate 102. As shown in FIG. 3, the flap 114 is positioned beyond the plane of the front side 104 of the substrate 102. When the flap 114 is moved out of the plane of the substrate 102, an opening 124 forms from the area of the bent flap 114. The flap 114 terminates at the first end 121 of cut 120 and at the second end 123 of the cut 120.

Figure 4:
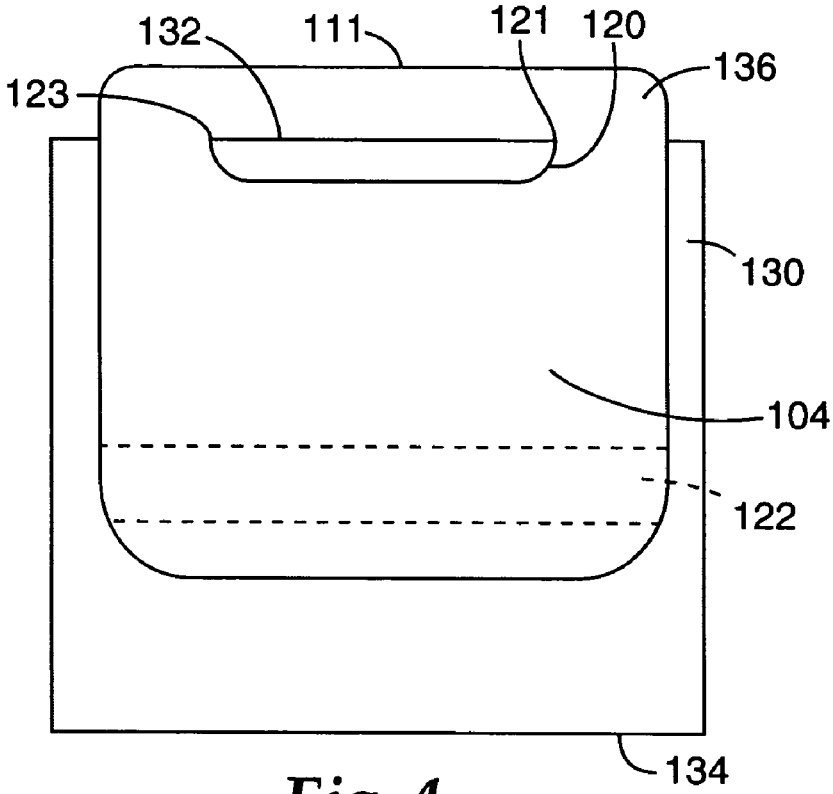
FIG. 4 is a plan view of the front side of the tab of FIG. 1 engaged with a top of a sheet of paper to form a tab.

FIG. 4 is a plan view of the tab 100 of FIG. 1 engaged with a top edge 132 of a sheet of paper (or any other sheet material) 130 to form a tab portion 136. The sheet of paper 130 has a top edge 132 that is positioned between the flap 114 and the back side 106 of the substrate 102 (see FIGS. 1–3) and abuts against the first end 121 and second end 123 of the cut 120. Because the first distance 126 and second distance 128 are equal (see FIG. 1), when the top edge 132 of the sheet of paper 130 abuts the first end 121 of cut 120 and second end 123 of cut 120, a tab portion 136 having a uniform size and shape compared to other similar tabs 100 placed on other sheets of paper will form. It should be noted that while a sheet of paper is referred to throughout the specification as being the most likely application of the tab, any sheet material (or multiple sheets of sheet material), such as plastic sheets are contemplated by the invention.

When the tab 100 is attached to a sheet of paper 130, the adhesive 122 on the lower portion 110 of the back side 106 of the substrate 102 adhere to the sheet of paper 130. The back side 106 is opposite the front side 104 and is shown in FIG. 2. The adhesive 122 (shown in phantom in FIG. 4) secures the lower portion 110 of the tab 100 to the sheet of paper 130 while the contact between the top edge 132 of the sheet of paper 130 with the flap 114 mechanically secures the upper portion 108 of the tab 100 to the sheet of paper 130.

The tab portion 136 is that portion of the tab 100 extending beyond the top edge 132 of the sheet of paper 130. The tab portion 136 shown is generally rectangular shaped, however the tab portion 136 may be any shape so long as it is capable of extending beyond the top edge 132 of the sheet of paper 130. By simply positioning the flap 114 out of the plane of the substrate 102 and inserting a sheet of paper 130 between the flap 114 and back side 106 of the tab 100, a consistent and uniform tab 136 is formed along the sheet of paper 130. A large tab similar to that shown in FIG. 4 provides a writing surface on the front side 104 for making notes related to the sheet of paper 130.

Figure 5:
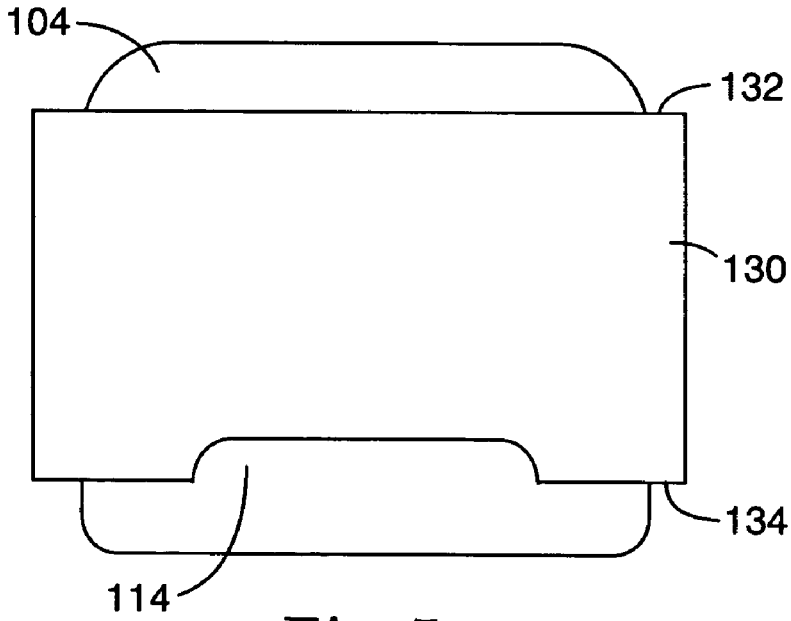
FIG. 5 is a plan view of the front side of the tab of FIG. 1 engaged with a bottom of a sheet of paper to hold the sheet.

The present invention can also serve as a sheet, card, or photo holder when mounted upside down on a vertical surface. FIG. 5 is a plan view of the tab 100 (turned upside down relative to its orientation in FIG. 4) engaged with a bottom edge 134 of the sheet of paper 130 to hold the sheet. In addition to being capable of forming a tab portion 136, which is used to flag a particular sheet of paper from a stack of papers, the tab 100 may be used as a holder. The tab 100 is inverted compared to its orientation in FIG. 4 such that the bottom edge 134 of the sheet of paper 130 rests between the flap 114 and the front side 104 of the substrate. The adhesive 122 on the lower portion 110 of the back side 106 of the substrate 102, opposite the flap 114 (see FIG. 2) adheres to a supporting surface such as a wall, desk, refrigerator, or other surface for displaying the sheet of paper 130. The flap 114 serves to mechanically hold the sheet of paper 130 in place on the tab 100.

The tab 100 shown in FIGS. 1–5 is overall generally square shaped with a generally U-shaped cut 120. A larger tab 100 is useful so that the surface of the front side 104 of the substrate 102, while attached to a sheet of paper 130 as shown in FIG. 4, becomes a writing surface for making notes or other markings. In such a case, the surface of the front side 104 may have lines for making notes. The tab 100 may be any other size, shape, or color. The tab portion 136 may be of another color than the rest of the tab 100. Also, the tab portion 136 could be preprinted with indicia on the tab portion 136 or have lines for writing on the tab portion 136. Other embodiments of repositionable tabs are shown in FIGS. 6A–6E FIG. 6A is a plan view of the front side 204 of another embodiment of a tab 200. In this embodiment, the overall shape of the tab 200 is generally rectangular shaped. The cut 220 that forms the flap 214 is generally U-shaped. Overall, the tab 200 is symmetrical about a longitudinal axis 212. When a sheet of paper is positioned between the flap 214 and the back side of the tab, similar to as shown in FIG. 4, a tab portion 236, which is rectangular shaped, extends beyond the sheet of paper. An adhesive band 222, shown in phantom, on the back side is positioned opposite the cut 220 to adhere to a sheet of paper.

Figure 6A:
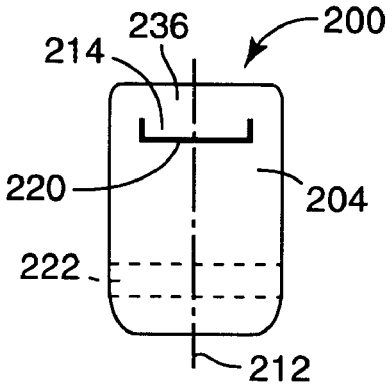
FIG. 6A is a plan view of a front side of another embodiment of a tab.
Figure 6B:
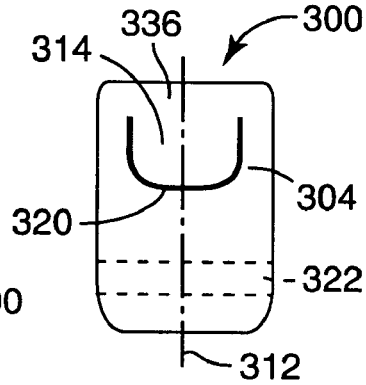
FIG. 6B is a plan view of a front side of another embodiment of a tab.

FIG. 6B is a plan view of the front side 304 of another embodiment of a tab 300. In this embodiment, the overall shape of the tab 300 is generally rectangular shaped. The cut 320 that forms the flap 314 is generally U-shaped. Overall, the tab 300 is symmetrical about a longitudinal axis 312. When a sheet of paper is positioned between the flap 314 and the back side of the tab, similar to as shown in FIG. 4, a tab portion 336, which is rectangular shaped, extends beyond the sheet of paper. An adhesive band 322, shown in phantom, on the back side is positioned opposite the cut 320 to adhere to a sheet of paper.

Figure 6C:
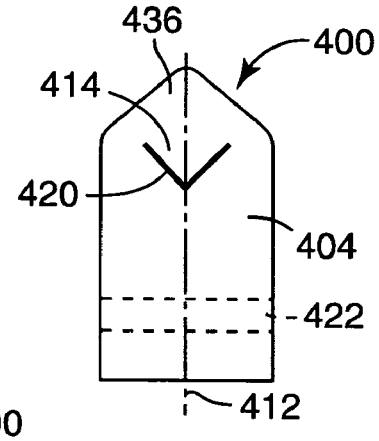
FIG. 6C is a plan view of a front side of another embodiment of a tab.

FIG. 6C is a plan view of the front side 404 of another embodiment of a tab 400. In this embodiment, the overall shape of the tab 400 is generally rectangular shaped with a triangular top. The cut 420 that forms the flap 414 is generally V-shaped. Overall, the tab 400 is symmetrical about a longitudinal axis 412. When a sheet of paper is positioned between the flap 414 and the back side of the tab, similar to as shown in FIG 4, a tab portion 436, which is triangular shaped, extends beyond the sheet of paper. An adhesive band 422, shown in phantom, on the back side is positioned opposite the cut 420 to adhere to a sheet of paper.

Figure 6D:
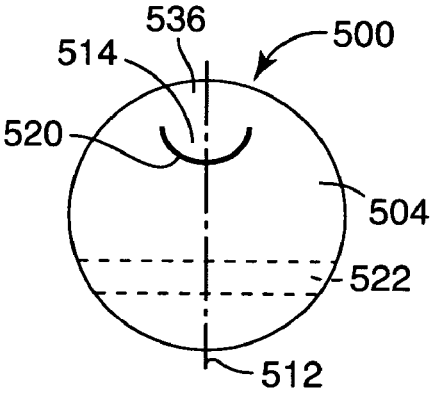
FIG. 6D is a plan view of a front side of another embodiment of a tab.

FIG. 6D is a plan view of the front side 504 of another embodiment of a tab 500. In this embodiment, the overall shape of the tab 500 is generally circular shaped. The cut 520 that forms the flap 514 is generally crescent-shaped. Overall, the tab 500 is symmetrical about a longitudinal axis 512. When a sheet of paper is positioned between the flap 514 and the back side of the tab, similar to as shown in FIG. 4, a tab portion 536, which is arc- shaped, extends beyond the sheet of paper. An adhesive band 522, shown in phantom, on the back side is positioned opposite the cut 520 to adhere to a sheet of paper.

Figure 6E:
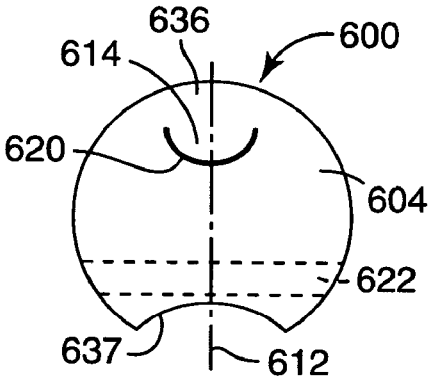
FIG. 6E is a plan view of a front side of another embodiment of a tab.

FIG. 6E is a plan view of the front side 604 of another embodiment of a tab 600. In this embodiment, the overall shape of the tab 600 is generally circular shaped with a bottom edge 637 of the tab 600 having a portion removed to form an arc-shape. The arc-shape at the bottom edge 637 indicates to a user the bottom and the general location of an adhesive band 622, shown in phantom. The bottom could be indicated by other edge shapes or by suitable indicia, with a crescent portion removed to indicate a bottom. The cut 620 that forms the flap 614 is generally crescent-shaped. Overall, the tab 600 is symmetrical about a longitudinal axis 612. When a sheet of paper is positioned between the flap 614 and the back side of the tab, similar to as shown in FIG. 4, a tab portion 636, which is arc-shaped, extends beyond the sheet of paper. The adhesive band 622, shown in phantom, on the back side is positioned opposite the cut 620 to adhere to a sheet of paper.

FIGS. 6A–6E show the front sides of the tabs. The back sides of the embodiments shown in FIGS. 6A–6E are similar to the back side 106 shown in FIG. 2 for tab 100. In each embodiment of the tab, an adhesive band is placed across the repositionable tab on the back side at the end opposite from the cut.

Each of the tabs depicted in FIGS. 6A–6E may be used in conjunction with a sheet of paper similar to that shown in both FIG. 4 and FIG. 5. In each embodiment shown in FIGS. 1–6E, the distance from the first end of the cut to the top edge of the tab and from the second end of the cut to the top edge of the tab is equal. Although each of the embodiments depicted is shown as symmetrical about a longitudinal axis, any size or shape may be used. Further, any size or shape of cut may be used so long as a tab of the desired shape results.

Figure 7:
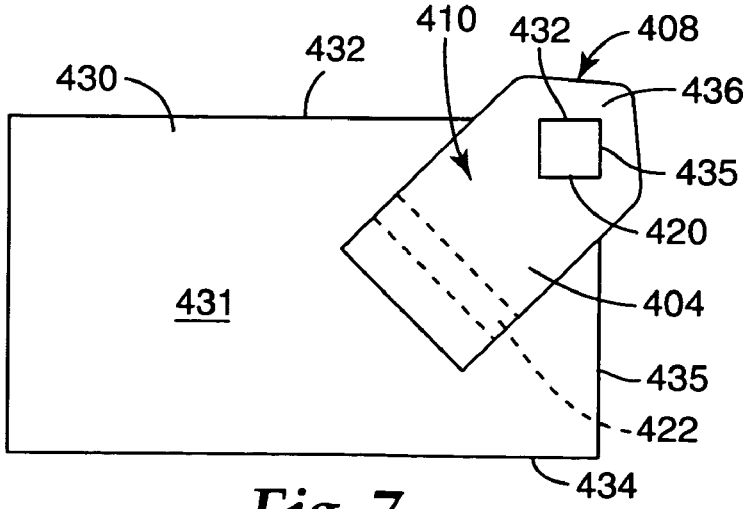
FIG. 7 is a plan view of the tab of FIG. 6C engaged with a corner a sheet of paper to form a tab.

FIG. 7 is a plan view of the tab 400 of FIG. 6C engaged with a corner a sheet of paper 430 to form a tab portion 436. The sheet of paper 430 having a front side 431 is positioned between the flap 414 and the back side 406, where the back side 406 is similar to back side 106 shown in FIG. 2. A top edge 432 and a side edge 435 of the sheet of paper 430 extend through the flap 414 and engage cut 420. Because the cut 420 is symmetrical and each end of the cut is an equal distance to a top edge of the tab 400, the tab portion 436 extends equally beyond the top edge 432 and side edge 435 of the sheet of paper 430. As with the embodiment depicted in FIG. 4, an adhesive band 422 (shown in phantom) is applied to the back side 406 of the lower portion 410 of the substrate 402. The adhesive band 422 contacts and adheres to the sheet of paper 430. The upper portion 408 of the substrate 402 engages with the corner of the sheet of paper 430 and the flap 414 (see FIG. 6C) mechanically engages with the corner of the sheet of paper to prevent movement of the sheet of paper 430 out of the tab 400.

When provided with repositionable pressure sensitive adhesive, the tab provides a tab portion that can be positioned on a sheet of paper (or any other sheet material) and then removed and repositioned on a different sheet of paper. The tab may provide a traditional rectangular tab portion along the top of a sheet of paper that is properly and uniformly aligned with the top of the sheet of paper to give the tab a uniform and professional appearance. Further, the tab may be of different shapes and sizes and may be positioned at a corner or bottom of a sheet of paper. The tab may be large enough such that a writing surface is provided which gives an area for making notes relating to the flagged page without marking directly on the flagged page.

The tabs utilizing repositionable adhesive (or "repositionable" tabs) may be packaged such that they are stacked on one another with the adhesive band on the back side adhering to the front side of the next "repositionable" tab similar to a pad of Post-it® brand notes available from 3M Company of St. Paul, Minn. The repositionable tabs may also be provided on a continuous liner with the adhesive band facing the liner surface.

Although the present invention has been described with reference to preferred embodiments, workers skilled in the art will recognize that changes may be made in form and detail without departing from the spirit and scope of the invention.

The invention claimed is:

1. A tab for attaching to sheet material having an edge, the tab comprising:

a substrate including a front side and a back side opposite the front side, the substrate further including an upper portion and a lower portion;

a cut through the upper portion of the substrate to form a flap; and an adhesive along the lower portion of the back side of the substrate, and the upper portion being free of adhesive, wherein the edge of the sheet material is positioned against the cut between the flap and either the front side or the back side such that the upper portion of the substrate extends beyond the edge of the sheet material and wherein when the edge of the sheet material is positioned against the cut between the flap and the back side of the substrate, the adhesive adheres to the sheet of paper.

2. A tab for attaching to sheet material having an edge, the tab comprising:

a substrate including a front side and a back side opposite the front side, the substrate further including an upper portion and a lower portion;

a cut through the upper portion of the substrate to form a flap; and an adhesive along the lower portion of the back side of the substrate, and the upper portion being free of adhesive, wherein the edge of the sheet material is positioned against the cut between the flap and either the front side or the back side such that the upper portion of the substrate extends beyond the edge of the sheet material and wherein when the edge of the sheet material is positioned against the cut between the flap and the front side of the substrate, the adhesive adheres to a separate supporting surface.

* * * * *